US008861989B2

(12) United States Patent
Hara et al.

(10) Patent No.: US 8,861,989 B2
(45) Date of Patent: Oct. 14, 2014

(54) PRINTER CAPABLE OF RESOLVING A JAM OF A PRINT MEDIUM

(75) Inventors: Masashi Hara, Ibaraki-ken (JP); Masatoshi Fujimoto, Ibaraki-ken (JP); Hirokazu Yabune, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 329 days.

(21) Appl. No.: 12/852,655

(22) Filed: Aug. 9, 2010

(65) Prior Publication Data

US 2011/0064428 A1 Mar. 17, 2011

(30) Foreign Application Priority Data

Sep. 16, 2009 (JP) ..... P2009-214327

(51) Int. Cl.

| | |
|---|---|
| ***G03G 15/00*** | (2006.01) |
| ***B41J 29/38*** | (2006.01) |
| ***B41J 11/00*** | (2006.01) |
| ***B65H 29/00*** | (2006.01) |
| ***B41J 13/00*** | (2006.01) |

(52) U.S. Cl.

CPC ..... *G03G 15/70* (2013.01); *B41J 29/38* (2013.01); *B65H 2513/54* (2013.01); *B41J 11/006* (2013.01); *B65H 2511/528* (2013.01); *B65H 2801/06* (2013.01); *G03G 2215/00552* (2013.01); *B65H 29/00* (2013.01); *B41J 13/0009* (2013.01); *G03G 15/5012* (2013.01); *B65H 2513/512* (2013.01); *B41J 13/0045* (2013.01)

USPC ..... 399/21; 399/20

(58) Field of Classification Search

USPC ..... 399/18–21

See application file for complete search history.

(56) References Cited

U.S. PATENT DOCUMENTS

| | | | | |
|---|---|---|---|---|
| 4,247,193 | A * | 1/1981 | Kaneko et al. | 399/20 |
| 4,878,087 | A * | 10/1989 | Sakai et al. | 399/20 |
| 5,532,793 | A * | 7/1996 | Kogure | 399/19 |
| 5,678,123 | A * | 10/1997 | Kim | 399/21 |
| 7,484,731 | B2 * | 2/2009 | Gutierrez-Vazquez et al. | 271/258.04 |
| 7,896,344 | B2 * | 3/2011 | Nakada et al. | 271/303 |
| 8,145,077 | B2 * | 3/2012 | Miyauchi | 399/21 |

FOREIGN PATENT DOCUMENTS

| | | | |
|---|---|---|---|
| JP | 09-114156 | A | 5/1997 |
| JP | 2003-012214 | A | 1/2003 |
| JP | 2008-114977 | A | 5/2008 |
| JP | 4168081 | B1 | 10/2008 |
| WO | 2009/048059 | A1 | 4/2009 |

OTHER PUBLICATIONS

Japanese Office Action 2009-214327 Issued on Jun. 25, 2013.

* cited by examiner

*Primary Examiner* — Matthew G Marini
*Assistant Examiner* — Justin Olamit
(74) *Attorney, Agent, or Firm* — Nath, Goldberg & Meyer; Jerald L. Meyer

(57) ABSTRACT

A printer includes a printing unit configured to print on a print medium while transferring the print medium by a first transfer section, a transfer unit located downstream the printing unit in a transfer route and configured to transfer the print medium by a second transfer section, and a controller configured to control the printing unit and the transfer unit. The controller is configured to stop the first transfer section prior to the second transfer section upon detection of a jam of the print medium.

3 Claims, 7 Drawing Sheets

PRINTER CAPABLE OF RESOLVING A JAM OF A PRINT MEDIUM

CROSS REFERENCE TO RELATED APPLICATION

This application is based upon and claims the benefit of priority from the prior Japanese Patent Application No. 2009-214327, filed on Sep. 16, 2009, the entire contents of which are incorporated herein by reference.

BACKGROUND OF THE INVENTION

1. Field of the Invention

The present invention relates to a printer capable of resolving a jam of a print medium.

2. Description of the Related Art

A printer including a printing unit for printing images transferring a print medium such as a print sheet has been known. A printer capable of printing on both sides of a sheet tends to cause a jam of a print medium since a transfer distance downstream of the printing unit is long. Therefore, a technique for resolving the jam of the print medium has been required.

Japanese Patent Publication No. 4168081 discloses a printer for double-side printing that includes a sheet feeding means that feeds a print sheet, a transfer means located downstream of a sheet feed unit and having a printing unit, inverting rollers that invert the print sheet, and a sheet receiving tray for switchback.

When a jam of a print sheet is detected in the printer of the above-mentioned patent citation, the printer stops an operation of the sheet feeding means while keeping a drive of the transfer means. Thus, the printer stops feeding the following sheets while keeping transferring the current print sheets. Then, the current print sheets are discharged to the sheet receiving tray via the inverting rollers. When all the current print sheets are discharged to the sheet receiving tray, the transfer means is then stopped.

SUMMARY OF THE INVENTION

However, even when the jam of the print sheet is detected in the printer described in the above-mentioned patent citation, the transfer means is kept operating. As a result, there is a problem of the jam that is not easily resolved since the following sheets are jammed one after another at the jammed portion where the foregoing print sheet is jammed in the middle of the traveling route. In particular, although an area adjacent to the printing unit has a relatively enough space, the other areas other than the printing unit usually have little space because of a reduced size of the printer. As a result, it is difficult to resolve the jam when the print sheets are left in the areas other than the printing unit.

An object of the present invention is to provide a printer capable of easily resolving a jam of a print medium.

An aspect of the present invention is a printer comprising: a printing unit configured to print on a print medium while transferring the print medium by a first transfer section; a transfer unit located downstream the printing unit in a transfer route and configured to transfer the print medium by a second transfer section; and a controller configured to control the printing unit and the transfer unit and stop the first transfer section prior to the second transfer section upon detection of a jam of the print medium.

According to the above-described aspect, it is possible to reduce a possibility for a presence of the print medium in the second transfer section by stopping the first transfer section of the printing unit prior to the second transfer section of the transfer unit. Accordingly, it is possible to easily resolve the jam of the print medium since a removing process of the print medium from the transfer unit generally having a small space can be reduced.

The controller may be configured to stop the first transfer section prior to the second transfer section when determining that the jam is not resolved by transfer of the print medium a prescribed distance after detection of the jam.

According to the above-described configuration, when the jam is not resolved, the first transfer section of the printing unit is stopped prior to the second transfer section of the transfer unit. Accordingly, it is possible to reduce a possibility for the presence of the print medium in the second transfer section more reliably when the jam is continued.

The controller may be configured to stop the first transfer section and the second transfer section after discharge of the print medium when determining that the jam is resolved by transfer of the print medium a prescribed distance after detection of the jam.

According to the above-described configuration, when the jam is resolved, the print medium is discharged by the first transfer section of the printing unit and the second transfer section of the transfer unit. Accordingly, it is possible to resolve the jam more easily, and further reduce processes to resolve the jam.

The printer may further comprise a print medium supply unit configured to supply and transfer the print medium to the printing unit. And the controller may be configured to control the print medium supply unit and stop transfer by the print medium supply unit when determining that the print medium is present between the printing unit and the print medium supply unit after detection of the jam.

According to the above-described configuration, after the print medium is transferred to an area between the printing unit and the print medium supply unit, the print medium supply unit stops transferring the print medium. Accordingly, it is possible to easily remove the print medium being transferred by the print medium supply unit.

The printer may further comprise an inverting unit configured to invert the print medium by temporarily introducing to a switchback unit having part exposed outward and re-feed the print medium as inverted to the printing unit. And the controller may be configured to control the inverting unit and stop transfer by the inverting unit after the print medium being transferred is transferred to the switchback unit by the inverting unit after detection of the jam.

According to the above-described configuration, after the print medium is transferred to the switchback unit of which a part is exposed outward, the inverting unit stops transferring the print medium. Accordingly, it is possible to easily remove the print medium being transferred by the inverting unit.

The controller may be configured to unconditionally stop the first transfer section after detection of the jam.

According to the above-described configuration, the first transfer section of the printing unit is unconditionally stopped after the jam is detected. Accordingly, it is possible to further reduce the print mediums transferred to the transfer unit.

The controller may be configured to drive the first transfer section again when determining that the jam is resolved and stop the first transfer section and the second transfer section after discharge of the print medium.

According to the above-described configuration, after the jam is resolved, the stopped first transfer section of the printing unit is driven again. Accordingly, it is possible to reduce a possibility for the presence of the print medium in the printing unit and the transfer unit.

The printer may further comprise sheet sensors provided along the transfer route to detect a jam. And the controller may be configured to at least temporarily keep transfer by any of the first transfer section and the second transfer section being located upstream a sheet sensor having detected the jam after detection of the jam.

According to the above-described configuration, the print sheet present upstream the sheet sensor having detected the jam can be also transferred to a predetermined position where the sheet is easy to be discharged or removed. In the conventional apparatus, the first transfer section located upstream the sheet sensor having detected the jam was stopped. As a result, the print sheet tended to be left upstream the sheet sensor having detected the jam in the conventional apparatus. Especially, when the print sheet was left in a position where the sheet was not easily removed by a user, the user was required to spend much effort for a recovery of the apparatus.

DETAILED DESCRIPTION OF THE EMBODIMENT

Hereinafter, a description will be made below in detail of an embodiment of the present invention with reference to the drawings.

First Embodiment

Figure 1:
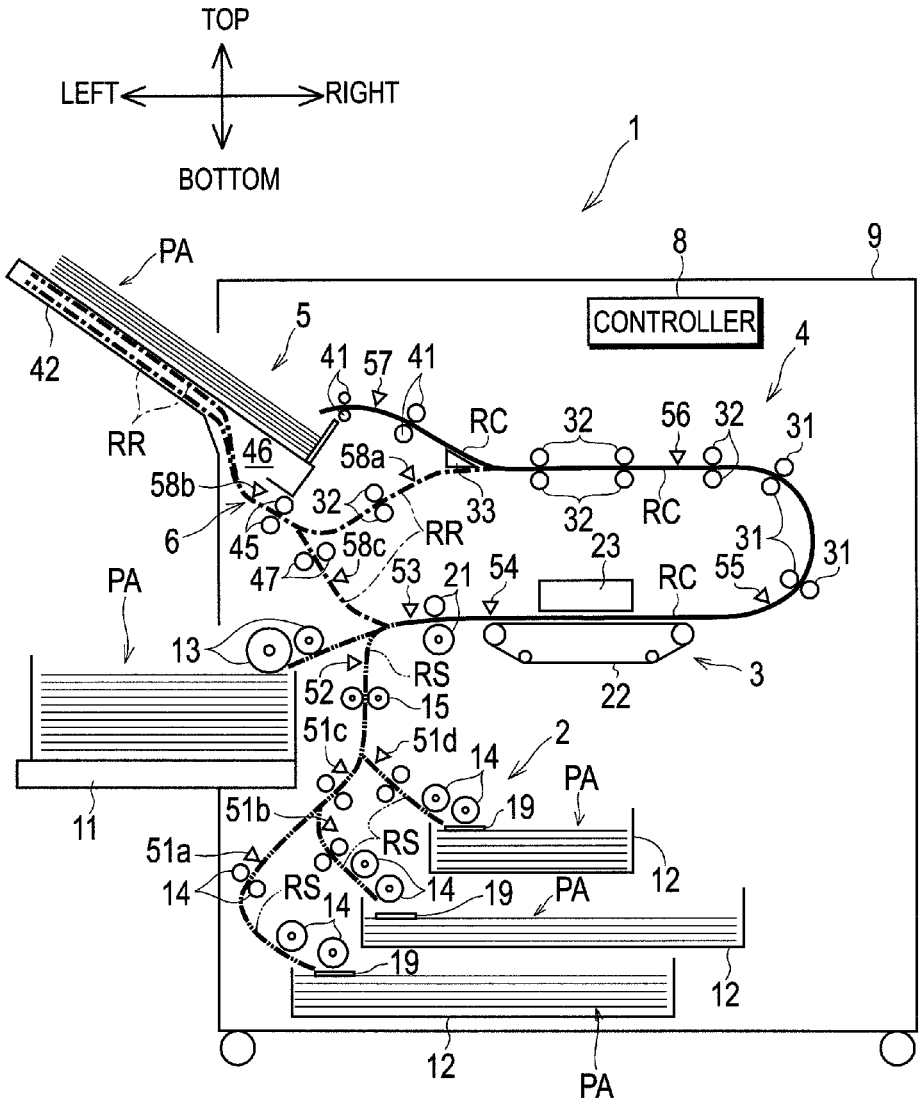
FIG. 1 is an overall schematic view of a printer for both-side printing according to a first embodiment of the present invention.
Figure 2:
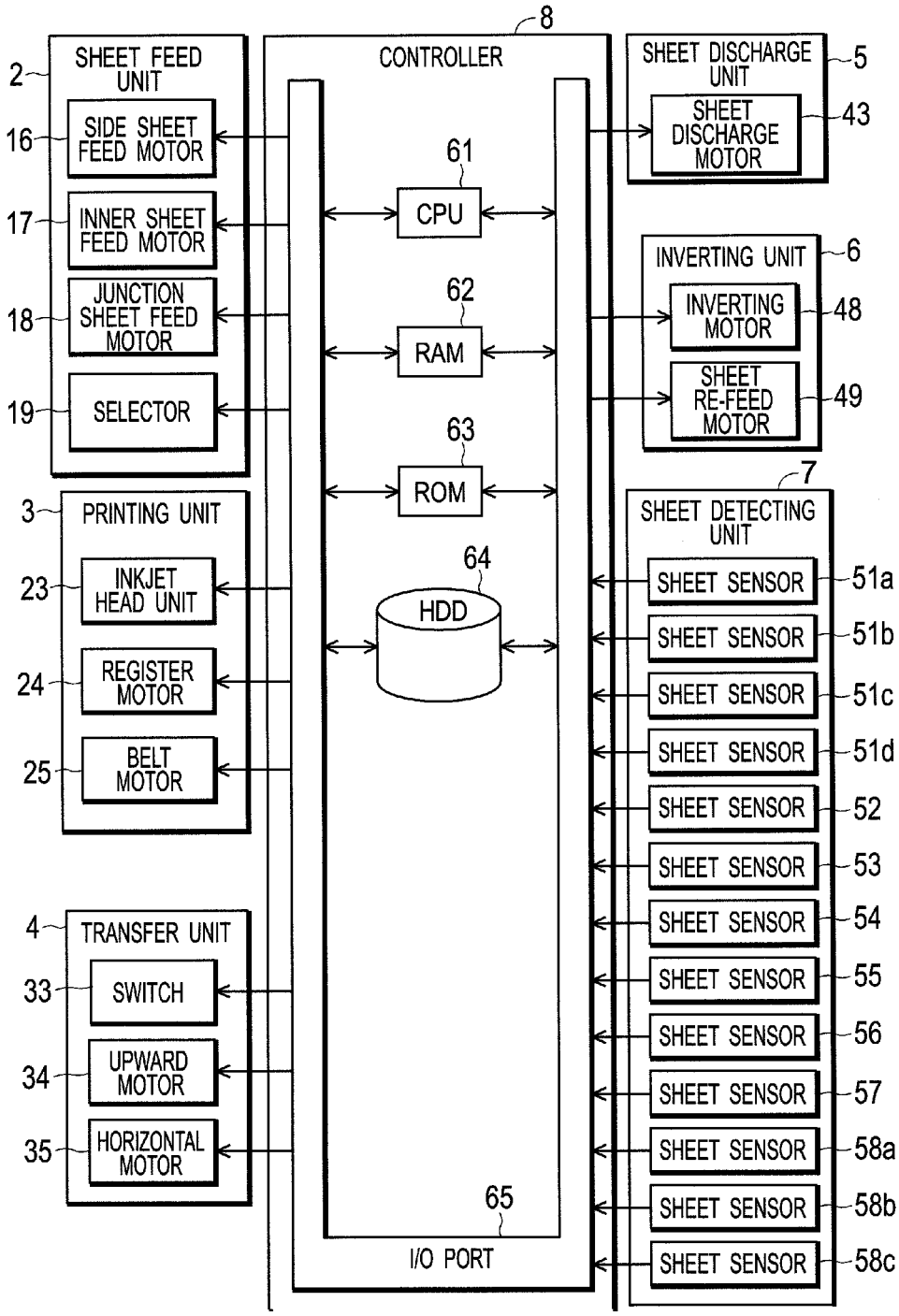
FIG. 2 is a block diagram for explaining a control system of a printer for both-side printing according to a first embodiment of the present invention.

FIG. 1 is an overall schematic view of a printer for both-side printing according to a first embodiment of the present invention. FIG. 2 is a block diagram for explaining a control system of the printer for both-side printing. In the following explanation, an obverse direction of the paper of FIG. 1 that a user is to stand is defined as a front side. In addition, the definition of the horizontal and vertical directions in FIG. 1 is the same as that in the following explanation.

In FIG. 1, a route indicated by a heavy line is a transfer route in which a print sheet is transferred. A route indicated by a solid line in the transfer route is a regular route RC. A route indicated by a chain line in the transfer route is an inverting route RR. A route indicated by a chain double-dashed line in the transfer route is a sheet feed route RS. In the following explanation, "upstream" and "downstream" represent upstream and downstream locations in the transfer route.

As shown in FIGS. 1 and 2, a printer for both-side printing 1 according to the first embodiment includes a sheet feed unit (a print medium supply unit) 2, a printing unit 3, a transfer unit 4, a sheet discharge unit 5, an inverting unit 6, a sheet detecting unit 7, a controller 8, and a casing 9 for housing the above-mentioned components.

The sheet feed unit 2 transfers and supplies (feeds) a print sheet (a print medium) PA. The sheet feed unit 2 is located most upstream in the transfer route. The sheet feed unit 2 includes a side sheet feed tray 11, three inner sheet feed trays 12, side sheet feed rollers 13, a plurality of pairs of inner sheet feed rollers 14, junction sheet feed rollers 15, a side sheet feed motor 16, an inner sheet feed motor 17, a junction sheet feed motor 18, and selectors 19.

The print sheet PA to be supplied is piled up on the sheet feed trays 11 and 12. A part of the side sheet feed tray 11 is exposed outward from the casing 9. The inner sheet feed trays 12 are housed inside the casing 9. The inner sheet feed trays 12 can be pulled out from the casing 9. The side sheet feed rollers 13 feed the print sheet PA stacked on the side sheet feed tray 11 to the printing unit 3. The side sheet feed rollers 13 are rotated and driven by the side sheet feed motor 16. The inner sheet feed rollers 14 transfer the print sheet PA stacked on any of the inner sheet feed trays 12 to the junction sheet feed rollers 15. The inner sheet feed rollers 14 are rotated and driven by the inner sheet feed motor 17. The junction sheet feed rollers 15 transfer the print sheet PA transferred by the inner sheet feed rollers 14 to the printing unit 3. The selectors 19 are arranged on each inner sheet feed tray 12 to select any of the inner sheet feed trays 12. The inner sheet feed tray 12 selected by the corresponding selector 19 is ready to feed the print sheet PA. When none of the inner sheet feed trays 12 is selected (nonselective condition), sheet feeding from the inner sheet feed trays 12 is stopped.

The printing unit 3 prints an image on the print sheet PA while transferring. The printing unit 3 is located downstream of the sheet feed unit 2. The printing unit 3 includes, as a first transfer section, register rollers 21, a belt transfer unit 22, an inkjet head unit 23, a register motor 24, and a belt motor 25.

The register rollers 21 transfer the print sheet PA fed from the sheet feed unit 2, or the print sheet PA re-fed from the inverting unit 6 to the belt transfer unit 22. The register rollers 21 are rotated and driven by the register motor 24. The belt transfer unit 22 transfers the print sheet PA transferred by the register rollers 21 to the transfer unit 4 while suctioning the print sheet PA. In the belt transfer unit 22, a belt transferring the print sheet PA is driven by the belt motor 25. The inkjet head unit 23 includes a plurality of inkjet heads (not shown in the figure). The inkjet heads eject various colors of ink, so as to print an image on the print sheet PA transferred by the belt transfer unit 22.

The transfer unit 4 transfers the print sheet PA printed by the printing unit 3 to the sheet discharge unit 5 or the inverting unit 6. The transfer unit 4 is located downstream of the printing unit 3. The transfer unit 4 includes, as a second transfer section, two pairs of upward transfer rollers 31, four pairs of horizontal transfer rollers 32, a switch 33, an upward motor 34, and a horizontal motor 35.

The upward transfer rollers 31 transfer the print sheet PA transferred from the printing unit 3 to the horizontal transfer rollers 32 located at an upper direction of the upward transfer rollers 31. The two pairs of the upward transfer rollers 31 are arranged in an upstream area in the regular route RC having a predetermined interval in the vertical direction. The two pairs of the upward transfer rollers 31 are rotated and driven by the upward motor 34. The horizontal transfer rollers 32 transfer the print sheet PA transferred by the upward transfer rollers 31 to the inverting unit 6 or the sheet discharge unit 5. The four pairs of the horizontal transfer rollers 32 are arranged in a downstream area in the regular route RC and an upstream area in the inverting route RR having predetermined intervals. The four pairs of the horizontal transfer rollers 42 are rotated and driven by the horizontal motor 35. The switch 33 switches the transfer route of the print sheet PA transferred by the horizontal transfer rollers 32 to any of the sheet discharge unit 5 and the inverting unit 6.

The sheet discharge unit 5 is configured to discharge the printed sheet PA to stack thereon. The sheet discharge unit 5 includes sheet discharge rollers 41, a sheet receiving tray 42, and a sheet discharge motor 43.

The sheet discharge rollers 41 discharge the printed sheet PA transferred from the transfer unit 4 to the sheet receiving tray 42. The sheet discharge rollers 41 are arranged between the switch 33 and the sheet receiving tray 42. The sheet discharge rollers 41 are rotated and driven by the sheet discharge motor 43. The printed sheet PA discharged by the sheet discharge rollers 41 is stacked on the sheet receiving tray 42. A part of the sheet receiving tray 42 is exposed from the casing 9. Accordingly, a user can easily remove the print sheet PA stacked on the sheet receiving tray 42.

The inverting unit 6 inverts the print sheet PA printed on one side to re-feed to the printing unit 3 when printing on both sides. The inverting unit 6 includes inverting rollers 45, a switchback unit 46, sheet re-feed rollers 47, an inverting motor 48, and a sheet re-feed motor 49.

The inverting rollers 45 send the print sheet PA printed on one side in the switchback unit 46. The inverting rollers 45 transfer the print sheet PA delivered from the switchback unit 46 to the sheet re-feed rollers 47. The inverting rollers 45 are rotated and driven by the inverting motor 48 in a normal rotating direction and a reverse rotating direction. The rotating direction of the inverting rollers 45 when sending the print sheet PA in the switchback unit 46 is defined as a normal rotating direction. The rotating direction of the inverting rollers 45 when delivering the print sheet PA to the sheet re-feed rollers 47 is defined as an inverting direction.

The switchback unit 46 is a space into which the inverting rollers 45 temporarily send the print sheet PA. The switchback unit 46 is a space provided at a lower portion of the sheet receiving tray 42 of which a part is exposed outward. In other words, a part of the switchback unit 46 is exposed outward. The switchback unit 46 is formed to be hollow. The switchback unit 46 is configured to be inclined downwardly toward the inverting rollers 45. The print sheet PA is temporarily introduced to the switchback unit 46 while being nipped by the inverting rollers 45. Then, the print sheet PA is transferred to the sheet re-feed rollers 47 from the switchback unit 46 by rotating and driving the inverting rollers 45 in the inverting direction.

The sheet re-feed rollers 47 re-feed the print sheet PA transferred from the inverting rollers 45 to the printing unit 3. The sheet re-feed rollers 47 are rotated by the sheet re-feed motor 49. The rotating direction of the sheet re-feed rollers 47 when transferring the print sheet PA to the printing unit 3 is defined as a normal rotating direction, and the reversed direction thereof is defined as an inverting direction.

The sheet detecting unit 7 detects the print sheets PA present at several positions in the transfer routes RC, RR and RS. The sheet detecting unit 7 includes a plurality of sheet sensors 51*a* to 51*d*, 52, 53, 54, 55, 56, 57 and 58*a* to 58*c* for detecting the presence or absence of the print sheets PA.

The sheet sensors 51*a* to 51*d* are arranged between the inner sheet feed trays 12 and the junction sheet feed rollers 15. The sheet sensor 52 is arranged adjacent to and upstream of the register rollers 21. The point where the sheet sensor 53 is arranged is a point where the print sheets PA transferred from the side sheet feed tray 11, the inner sheet feed trays 12 and the inverting unit 6 meet.

The sheet sensor 54 is arranged upstream of the belt transfer unit 22. The sheet sensor 55 is arranged upstream of the transfer unit 4. The sheet sensor 56 is arranged between the horizontal transfer rollers 32 and the horizontal transfer rollers 32 adjacent to each other. The sheet sensor 57 is arranged between the sheet discharge rollers 41 and the sheet discharge rollers 41 adjacent to each other of the sheet discharge unit 5. Namely, the sheet sensor 57 is arranged most downstream in the regular route RC.

The sheet sensors 58*a* to 58*c* are arranged in the inverting route RR. Specifically, the sheet sensor 58*a* is arranged in the most upstream area of the inverting route RR and upstream of the horizontal transfer roller 32 located most downstream. The sheet sensor 58*b* is arranged between the inverting rollers 45 and the switchback unit 46. The sheet sensor 58*c* is arranged downstream of the sheet re-feed rollers 47.

The following are explanations of the control system of the printer for both-side printing 1 with reference to FIG. 2.

The controller 8 controls the whole operations of the printer for both-side printing 1. More specifically, the controller 8 controls the sheet feed unit 2, the printing unit 3, the transfer unit 4, the discharge unit 5, the inverting unit 6 and the sheet detecting unit 7. As shown in FIG. 2, the controller 8 includes a CPU 61 that executes various programs, a RAM 62 that temporarily stores various information, a ROM 63 that stores basic programs and the like, an HDD 64 that stores a printing program, a jam program, and the like, and an I/O port 65 that performs input/output.

The sheet feed motors 16 to 18 and the selectors 19 of the sheet feed unit 2 are connected to the I/O port 65 so as to receive a signal from the I/O port 65. Thus, the controller 8 can feed the print sheet PA from any of the sheet feed trays 11 and 12.

The inkjet head unit 23 and the motors 24 and 25 of the printing unit 3 are connected to the I/O port 65 so as to receive a signal from the I/O port 65. Thus, the controller 8 can print an image on the print sheet PA while transferring the print sheet PA.

The switch 33 and the motors 34 and 35 of the transfer unit 4 are connected to the I/O port 65 so as to receive a signal from the I/O port 65. Thus, the controller 8 can transfer the print sheet PA to the discharge unit 5 or the inverting unit 6.

The sheet discharge motor 43 of the sheet discharge unit 5 is connected to the I/O port 65 so as to receive a signal from the I/O port 65. Thus, the controller 8 can discharge the printed sheet PA to the sheet receiving tray 42.

The motors 48 and 49 of the inverting unit 6 are connected to the I/O port 65 so as to receive a signal from the I/O port 65. Thus, the controller 8 can invert the print sheet PA transferred from the transfer unit 4 to re-feed to the printing unit 3.

The sheet sensors 51*a* to 51*d*, 52, 53, 54, 55, 56, 57 and 58*a* to 58*c* of the sheet detecting unit 7 are connected to the I/O port 65 so as to receive a signal from the I/O port 65. Thus, the controller 8 can detect the presence or absence of the print sheets PA in the transfer routes RC, RR and RS, and determine a jam of the print sheet PA.

(Printing Operation)

The following are explanations of printing operations of the printer for both-side printing 1 according to the above-mentioned first embodiment.

First, the print sheet PA not printed is transferred to the printing unit 3 from any of the sheet feed trays 11 and 12 along the sheet feed route RS by the sheet feed rollers 13 and 14. In the printing unit 3, the print sheet PA is transferred to the belt transfer unit 22 by the register rollers 21. Then, an image is printed on the print sheet PA by ink ejected from the inkjet heads of the inkjet head unit 23 while the print sheet PA is transferred by the belt transfer unit 22. After printing, the print sheet PA is transferred to the transfer unit 4 by the belt transfer unit 22. In the transfer unit 4, the print sheet PA is transferred in a left direction by the horizontal transfer rollers 32 after being transferred upward by the upward transfer rollers 31.

When printing on one side, the print sheet PA is transferred to the sheet discharge unit 5. In the sheet discharge unit 5, the print sheet PA is discharged to the sheet receiving tray 42 by the sheet discharge rollers 41 while the print sheet PA is guided by the switch 33. Thus, the operation for one side printing is completed.

When printing on both sides, the print sheet PA is guided to the inverting route RR by the switch 33. In the inverting unit 6, the print sheet PA is temporarily delivered to the switchback unit 46 by the inverting rollers 45 while the print sheet PA is guided by a flipper (not shown in the figure). Then, the print sheet PA returned from the switchback unit 46 is re-fed to the printing unit 3 by the sheet re-feed rollers 47 while the print sheet PA is guided by the flipper.

In the printing unit 3, the print sheet PA is transferred by the belt transfer unit 22 while one side not printed of the print sheet PA faces the inkjet head unit 23. Thus, an image is printed on the side not printed in the print sheet PA by the inkjet head unit 23. Then, the print sheet PA printed on both sides is transferred to the sheet receiving tray 42 by the transfer unit 4 and the discharge unit 5. Accordingly, images are printed on both sides of the print sheet PA, and the operation for both side printing is completed.

(Jam Handling Processing)

Figure 3A:
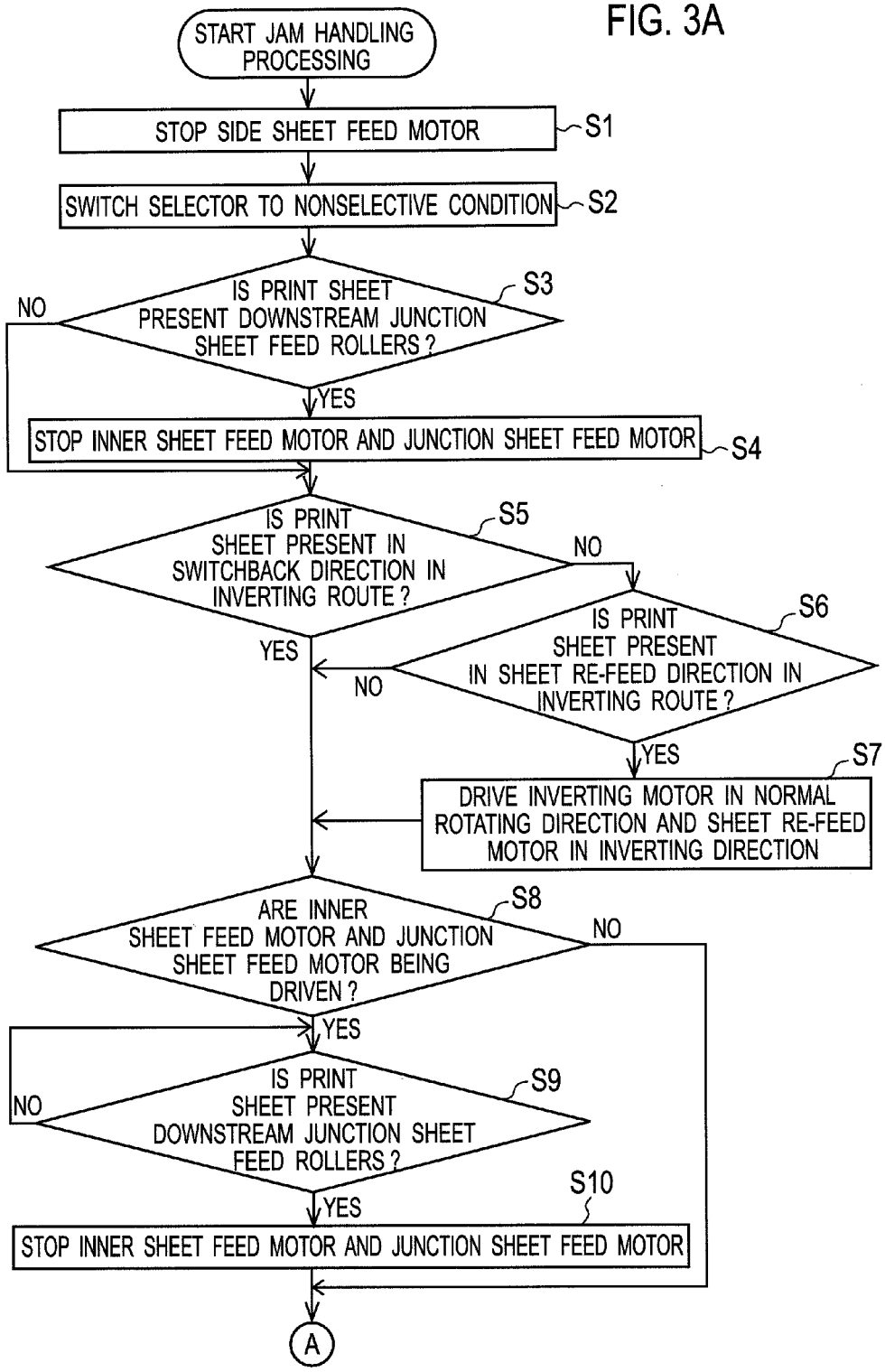
FIGS. 3A and 3B are a flow chart for explaining jam handling processing according to a first embodiment of the present invention.
Figure 3B:
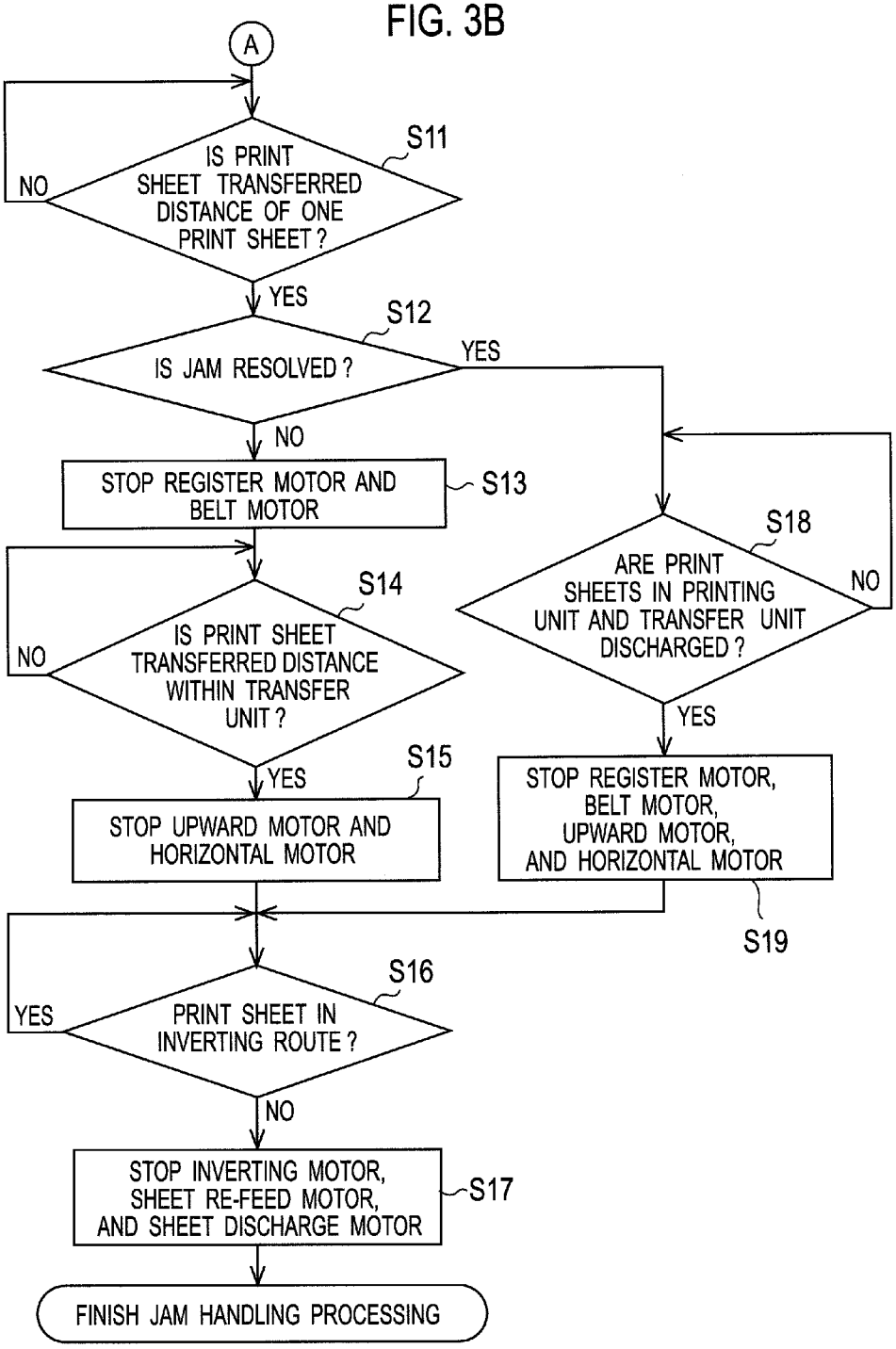

The following are explanations of jam handling processing and operations thereof according to the jam program executed by the controller 8 when a jam of the print sheet is detected during a printing operation. FIGS. 3A and 3B are a flow chart for explaining jam handling processing according to the first embodiment. The numbers indicated after "S" in FIGS. 3A and 3B represent the step numbers, respectively.

When a jam of the print sheet PA is detected during a printing operation, jam handling processing is started. Then, the controller 8 determines that a jam is caused when, for example, the print sheet PA detected by the respective sheet sensors 51 to 58 does not pass through detecting areas of the sheet sensors 51 to 58 within a certain period of time. Note that, when a jam is detected, the motors 16 to 18, 24, 25, 34, 35, 43, 48 and 49 are kept operating. Namely, it means that sheet transferring operated upstream of the sheet sensors 53 to 57 that have detected the jam is maintained even when any of the sheet sensors 54 to 57 detect the jam.

As shown in FIG. 3A, when the controller 8 detects the jam, the controller 8 stops the side sheet feed motor 16 (S1). Thus, sheet feeding of the print sheet PA to the printing unit 3 from the side sheet feed tray 11 by the side sheet feed rollers 13 is stopped. When the side sheet feed motor 16 is already stopped, the controller 8 keeps stopping the side sheet feed motor 16.

Next, the controller 8 switches the states of the selectors 19 so as not to be selected (S2). Thus, sheet feeding of the print sheet PA stacked on the inner sheet feed trays 12 is stopped.

Next, the controller 8 determines whether the print sheet PA being transferred is present or not downstream of the junction sheet feed rollers 15 according to a detection signal of the sheet sensor 52 (S3).

When the controller 8 determines that the print sheet PA is present downstream of the junction sheet feed rollers 15 (S3: Yes), the controller stops the inner sheet feed motor 17 and the junction sheet feed motor 18 (S4). In other words, when the controller 8 determines that the print sheet PA is present between the sheet feed unit 2 and the register rollers 21, the controller 8 stops the inner sheet feed motor 17 and the junction sheet feed motor 18. Thus, the inner sheet feed motor 17 and the junction sheet feed motor 18 of the sheet feed unit 2 stop transferring the print sheet PA, and the print sheet PA is stopped adjacent to and downstream of the junction sheet feed rollers 15. When the inner sheet feed motor 17 and the junction sheet feed motor 18 are already stopped, the controller 8 keeps stopping the inner sheet feed motor 17 and the junction sheet feed motor 18.

On the other hand, when the controller 8 determines that the print sheet PA is not present downstream of the junction sheet feed rollers 15 (S3: No), the controller 8 proceeds to the step S5 without stopping the inner sheet feed motor 17 and the junction sheet feed motor 18.

Next, the controller 8 determines whether the print sheet PA is present or not in a switchback direction in the inverting route RR according to detection signals of the sheet sensors 58*a* and 58*b* (S5).

When the controller 8 determines that the print sheet PA is present in the switchback direction in the inverting route RR (S5: Yes), the controller 8 keeps driving the inverting motor 48, and proceeds to the step S8. When the print sheet PA is present in the switchback direction in the inverting route RR, the inverting motor 48 is driven in a normal rotating direction. Namely, by keeping driving the inverting motor 48 in the normal rotating direction, the print sheet PA in the switchback direction in the inverting route RR is delivered to the switchback unit 46 by the inverting rollers 45.

On the other hand, when the controller 8 determines that the print sheet PA is not present in the switchback direction in the inverting route RR (S5: No), the controller 8 determines whether the print sheet PA is present or not in a sheet re-feed direction in the inverting route RR according to a detection signal of the sheet sensor 58*c* (S6).

When the controller 8 determines that the print sheet PA is present in the sheet re-feed direction in the inverting route RR (S6: Yes), the controller 8 drives the inverting motor 48 in the normal rotating direction, and also drives the sheet re-feed motor 49 in an inverting direction (S7). When the print sheet PA is present in the sheet re-feed direction in the inverting route RR, the inverting motor 48 is driven in the inverting direction, and the sheet re-feed motor 49 is driven in the normal rotating direction. Namely, the controller 8 switches the rotating directions of the inverting motor 48 and the sheet re-feed motor 49 to the reverse directions, respectively, in the step S7. Accordingly, the print sheet PA in the sheet re-feed direction in the inverting route RR is delivered to the switchback unit 46 by the inverting rollers 45 and the sheet re-feed rollers 47.

On the other hand, when the controller 8 determines that the print sheet PA is not present in the sheet re-feed direction in the inverting route RR (S6: No), the controller 8 keeps rotating and driving the inverting motor 48 and the sheet re-feed motor 49, and proceeds to the step S8. In this case, since the print sheet PA is not present in the inverting route RR, the controller 8 may keep rotating and driving the inverting motor 48 and the sheet re-feed motor 49.

Next, the controller 8 determines whether the inner sheet feed motor 17 and the junction sheet feed motor 18 are being driven or not (S8).

When the controller 8 determines that the inner sheet feed motor 17 and the junction sheet feed motor 18 are being driven (S8: Yes), the controller 8 determines whether the print sheet PA is present or not downstream of the junction sheet feed rollers 15 according to a detection signal of the sheet sensor 52 (S9). The controller 8 repeats the step S9 until the controller 8 determines that the print sheet PA is present downstream of the junction sheet feed rollers 15.

When the controller 8 determines that the inner sheet feed motor 17 and the junction sheet feed motor 18 are not driven (S8: No), the controller 8 proceeds to the step S11.

When the controller 8 determines the print sheet PA is present downstream of the junction sheet feed rollers 15 (S9: Yes), the controller 8 stops the inner sheet feed motor 17 and the junction sheet feed motor 18 (S10). In other words, when the controller 8 determines that the print sheet PA is present between the sheet feed unit 2 and the register rollers 21, the controller 8 stops the inner sheet feed motor 17 and the junction sheet feed motor 18. Accordingly, the inner sheet feed motor 17 and the junction sheet feed motor 18 of the sheet feed unit 2 stop transferring the print sheet PA, and the print sheet PA is stopped adjacent to and downstream of the junction sheet feed rollers 15.

Next, the controller 8 determines whether the print sheet PA is transferred traveling a transfer distance of just one print sheet (hereinafter, referred to as a transfer distance PL1) by the printing unit 3 and the transfer unit 4 after the jam is detected (S11). The controller 8 repeats the step S11 until the controller 8 determines that the print sheet PA is transferred traveling the transfer distance of one print sheet by the printing unit 3 and the transfer unit 4 after the jam is detected. Then, the controller 8 makes a decision for the step S11 based on rotation rates of the motors 24, 25, 34 and 35 of the printing unit 3 and the transfer unit 4 and a sheet size of image data.

When the controller 8 determines that the print sheet PA is transferred traveling the transfer distance PL1 (S11: Yes), the controller 8 determines whether the jam is resolved or not according to detection signals of the sheet sensors 54, 55, 56 and 57 (S12). When the print sheet PA is transferred traveling the transfer distance PL1, the controller 8 can determine that the jam is resolved due to the sheet sensors 53, 54, 55, 56, 57 and 58 of which the detection signals are shifted from the indication of the presence of the print sheet to the indication of the absence of the print sheet.

Next, when the controller 8 determines that the jam of the print sheet PA is not resolved (S12: No), the controller 8 stops the register motor 24 and the belt motor 25 of the printing unit 3 (S13). Namely, when the jam of the print sheet PA is not resolved, the controller 8 stops the register motor 24 and the belt motor 25 prior to the upward motor 34 and the horizontal motor 35. Accordingly, the register rollers 21 and the belt transfer unit 22 are stopped, and the transfer of the print sheet PA from the printing unit 3 to the transfer unit 4 is stopped. Meanwhile, the upward motor 34 and the horizontal motor 35 of the transfer unit 4 are kept operating.

Next, the controller 8 determines whether the print sheet is transferred traveling a distance within the transfer unit (hereinafter, referred to as a sheet discharge distance PL2) by the transfer unit 4 (S14). The controller 8 repeats the step S14 until the controller 8 determines that the print sheet PA is transferred traveling the distance within the transfer unit by the transfer unit 4. The sheet discharge distance PL2 represents a distance between the upward transfer rollers 31 arranged most upstream in the transfer unit 4 and the sheet receiving tray 42.

When the controller 8 determines that the print sheet PA is transferred traveling the sheet discharge distance PL2 (S14: Yes), the controller 8 stops the upward motor 34 and the horizontal motor 35 of the transfer unit 4 (S15). In other words, after all the print sheets PA being transferred in the transfer unit 4 are discharged to the sheet receiving tray 42 by the upward motor 34 and the horizontal motor 35, the upward motor 34 and the horizontal motor 35 are stopped. When the accordion-folded print sheet PA remains in the middle of the transfer unit 4, the following print sheets PA are collected to the portion where the accordion-folded print sheet PA remains.

Next, the controller 8 determines whether the print sheet PA is present or not in the inverting route RR (S16). The controller 8 repeats the step S16 until the controller 8 determines that the print sheet PA is not present in the inverting route RR (S16: Yes).

When the print sheet PA in the inverting route RR is transferred to the switchback unit 46 by the inverting rollers 45 and the sheet re-feed rollers 47 of the inverting unit 6 and the controller 8 determines that the print sheet PA is not present in the inverting route RR (S16: No), the controller 8 stops the sheet discharge motor 43 with the inverting motor 48 and the sheet re-feed motor 49 of the inverting unit 6 (S17).

Thus, all the motors 16 to 18, 24, 25, 34, 35, 43, 48 and 49 are stopped, and the jam handling processing is completed.

On the other hand, when the controller 8 determines that the jam is resolved at the step S12 (S12: Yes), the controller 8 determines whether all the print sheets PA being transferred in the printing unit 3 and the transfer unit 4 are discharged according to the sheet sensors 54 to 57 (S18). The controller 8 repeats the step S18 until all the print sheets PA being transferred in the printing unit 3 and the transfer unit 4 are discharged.

When the controller 8 determines that all the print sheets PA being transferred in the printing unit 3 and the transfer unit 4 are discharged according to the sheet sensors 54 to 57 (S18: Yes), the controller 8 stops the register motor 24 and the belt motor 25 of the printing unit 3, and the upward motor 34 and the horizontal motor 35 of the transfer unit 4 (S19).

Then, the controller 8 executes processing of the above-mentioned steps S16 and S17. Accordingly, all the motors 16 to 18, 24, 25, 34, 35, 43, 48 and 49 are stopped, and the jam handling processing is completed.

(Effect of Printer for Both-Side Printing)

The following are explanations of effects of the printer for both-side printing 1 according to the above-described first embodiment.

As described above, in the printer for both-side printing 1 according to the first embodiment, the controller 8 maintains the transfer of the print sheets PA by the printing unit 3 and the transfer unit 4 after the jam of the print sheet PA is detected. When the jam is not resolved, the controller 8 maintains the transfer of the print sheets PA by the transfer unit 4 while stopping the transfer of the print sheets PA to the transfer unit 4 by the printing unit 3. Therefore, the print sheets PA being transferred in the transfer unit 4 are sequentially discharged to the discharge unit 5, so that the print sheets PA in the transfer unit 4 are decreased. Accordingly, a user can easily resolve the jam since the removal process of the print sheets in the transfer unit 4 having a small space can be reduced. In addition, when the accordion-folded print sheet PA remains in the transfer unit 4, the print sheets PA being transferred are collected to the portion where the accordion-folded print sheet PA remains. Consequently, a user can easily resolve the jam since portions where a removal process of the print sheets PA is required are reduced.

In addition, in the printer for both-side printing 1, when the controller 8 determines that the jam is resolved by maintaining the transfer of the print sheets PA by the printing unit 3 and the transfer unit 4 after the jam of the print sheet PA is detected, the controller 8 maintains the transfer of the print sheets PA by the printing unit 3 and the transfer unit 4 until all the print sheets PA being transferred by the printing unit 3 and the transfer unit 4 are discharged to the sheet receiving tray 42. Accordingly, it is possible to resolve the jam without performing any jam resolution process by a user since the print sheets PA are not present in the printing unit 3 and the transfer unit 4.

Moreover, in the printer for both-side printing 1, the controller 8 transfers the print sheet PA in the inverting route RR to the switchback unit 46 when the controller 8 detects the jam. Since a part of the switchback unit 46 is exposed outward, a user can easily remove the print sheet PA being printed from the switchback unit 46.

Furthermore, in the printer for both-side printing 1, the controller 8 transfers the print sheet PA in the sheet feed route RS downstream of the junction sheet feed rollers 15 when the controller 8 detects the jam. Therefore, it is possible to prevent the print sheet PA from being cut off inside the printer even when a user accidentally pulls out the inner sheet feed tray 12 having a pullout structure. Moreover, a user can open a front cover (not shown in the figure) provided in front of the junction sheet feed rollers 15 so as to easily pull out the print sheet PA by transferring the print sheet PA downstream of the junction sheet feed rollers 15.

The conventional printer stopped a transfer means (a motor) provided upstream of a sheet sensor that had detected a jam. As a result, a print sheet was left upstream of the sheet sensor in a transfer route. Especially, when the print sheet was left in a position hard to remove the print sheet by a user, the user was required to spend much effort for a recovery of an apparatus. On the other hand, in the printer for both-side printing 1 according to the first embodiment of the present invention, the controller 8 keeps driving the motors 24, 25, 34, 35 and 43 located upstream of the sheet sensors 54 to 57 that have detected the jam after the jam is detected. Accordingly, the printer for both-side printing 1 can transfer the print sheet PA present upstream of the sheet sensors 54 to 57 that have detected the jam to a predetermined position easy to discharge or remove the print sheet PA. For example, when a user touches the print sheet PA to be discharged to the sheet receiving tray 42, a jam may be detected by the sheet sensor 57. The conventional printer stopped a transfer unit located upstream of the sheet sensor even in a case of such a jam. That is, since approximately all the transfer units were stopped, most of the print sheets being transferred were left in the regular route RC. However, in the printer for both-side printing 1 according to the first embodiment of the present invention, when the jam is detected by the sheet sensor 57, the print sheet PA is not easily accordion-folded. Accordingly, approximately all the print sheets PA in the regular route RC can be discharged.

Second Embodiment

Figure 4A:
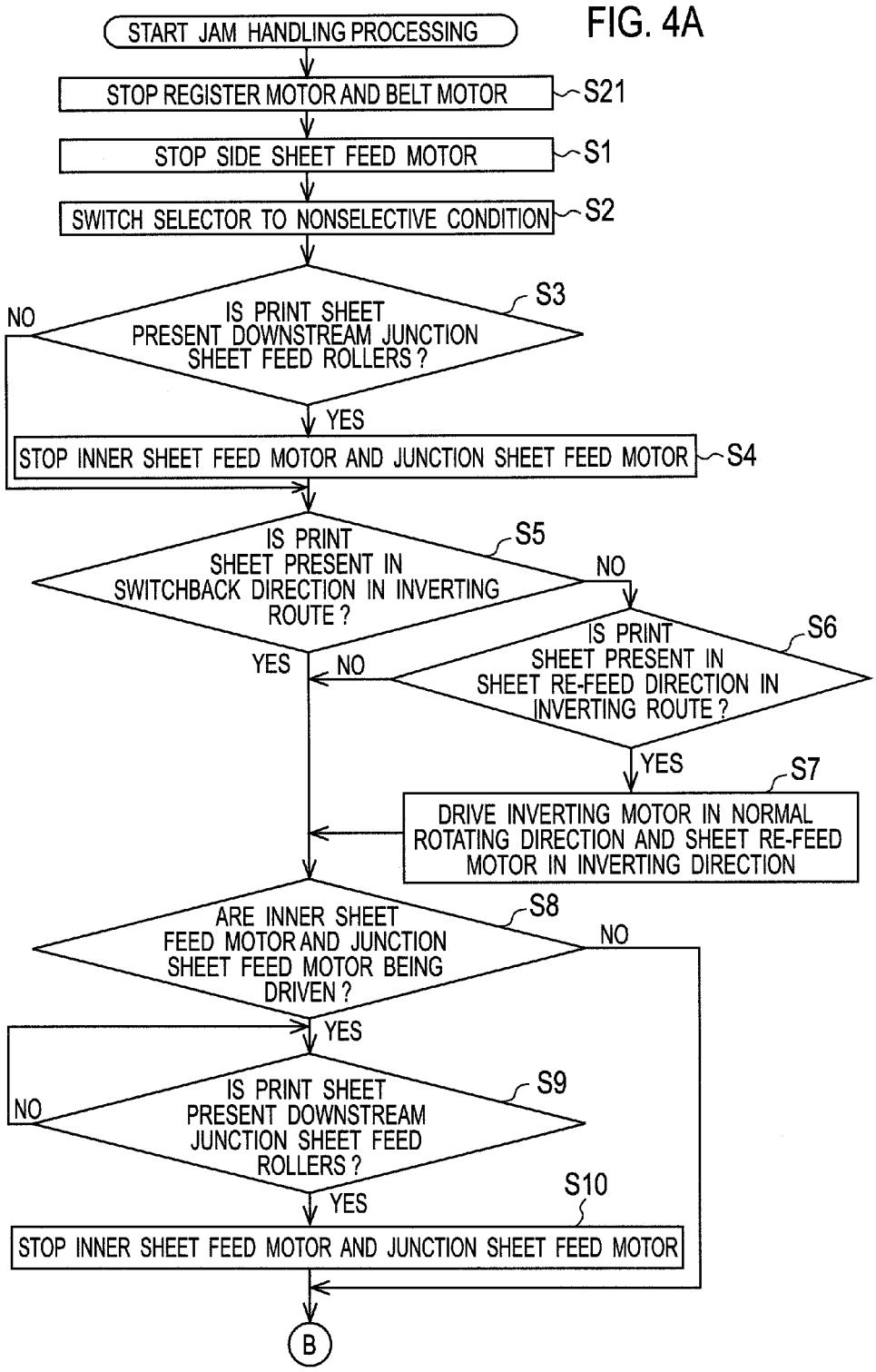
FIGS. 4A and 4B are a flow chart for explaining jam handling processing according to a second embodiment of the present invention.
Figure 4B:
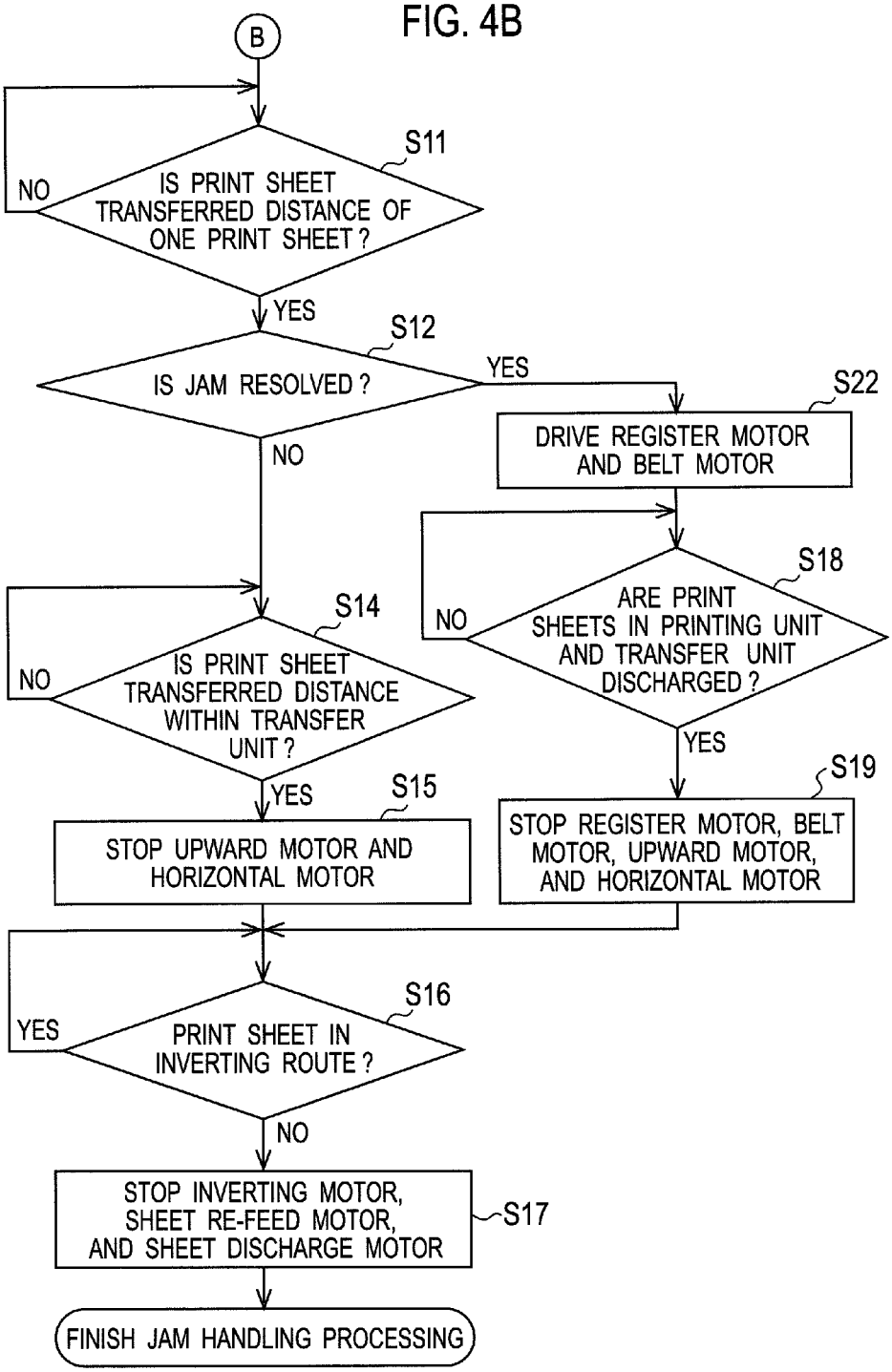

The following are explanations of a second embodiment in which the jam handling processing of the above-described first embodiment is modified. FIGS. 4A *and* 4B are a flow chart for explaining jam handling processing according to the second embodiment. The same compositions as those in the above-described first embodiment are indicated by the same reference numerals, and the explanations thereof are not repeated. In addition, the same processes as those in the above-described first embodiment are indicated by the same step numbers, and the explanations thereof are not repeated.

As shown in FIG. 4A, when the jam is detected, the controller 8 unconditionally stops the register motor 24 and the belt motor 25 of the printing unit 3 (S21). Thus, the transfer of the print sheets PA from the printing unit 3 to the transfer unit 4 by the register rollers 21 and the belt transfer unit 22 is stopped.

Then, the controller 8 executes processing from the step S1 to the step S11 similarly to the first embodiment.

Next, when the controller 8 determines that the jam is not resolved (S12: No), the controller 8 executes processing from the step S14 to the step S17 similarly to the first embodiment. Since the register motor 24 and the belt motor 25 are stopped in the step S21, the step S13 is omitted in the second embodiment.

Meanwhile, when the controller 8 determines that the jam is resolved (S12: Yes), the controller 8 drives the register motor 24 and the belt motor 25 of the printing unit 3 again (S22). Thus, the transfer of the printing sheets PA being stopped in the printing unit 3 is restarted.

Next, the controller 8 determines whether all the print sheets PA being transferred in the printing unit 3 and the transfer unit 4 are discharged or not according to the sheet sensors 54 to 57 (S18). The controller 8 repeats the step S18 until all the print sheets PA being transferred in the printing unit 3 and the transfer unit 4 are discharged. When the controller 8 determines that all the print sheets PA being transferred in the printing unit 3 and the transfer unit 4 are discharged (S18: Yes), the controller 8 stops the register motor 24 and the belt motor 25 of the printing unit 3, and the upward motor 34 and the horizontal motor 35 of the transfer unit 4 (S19).

Then, the controller 8 executes processing of the step S16 and the step S17 similarly to the first embodiment.

Accordingly, all the motors 16 to 18, 24, 25, 34, 35, 43, 48 and 49 are stopped, and the jam handling processing is completed.

In the second embodiment as described above, the controller 8 unconditionally stops the register motor 24 and the belt motor 25 of the printing unit 3 after the jam is detected. Thus, the transfer of the print sheets PA from the printing unit 3 to the transfer unit 4 is immediately stopped after the jam is caused. Therefore, it is possible to further reduce the transfer of the print sheets PA to the transfer unit 4 that has a small extra space and from which the print sheet PA is difficult to be removed. Accordingly, a user can easily resolve the jam since it is possible to prevent the jam from being further worsened.

In addition, when the controller 8 determines that the jam is resolved, the controller 8 drives the register motor 24 and the belt motor 25 again. Therefore, the print sheets PA being stopped in the printing unit 3 are transferred to the sheet receiving tray 42 by the printing unit 3 and the transfer unit 4. Accordingly, a user can easily resolve the jam since the print sheets PA left in the printing unit 3 and the transfer unit 4 can be further reduced.

Third Embodiment

Figure 5:
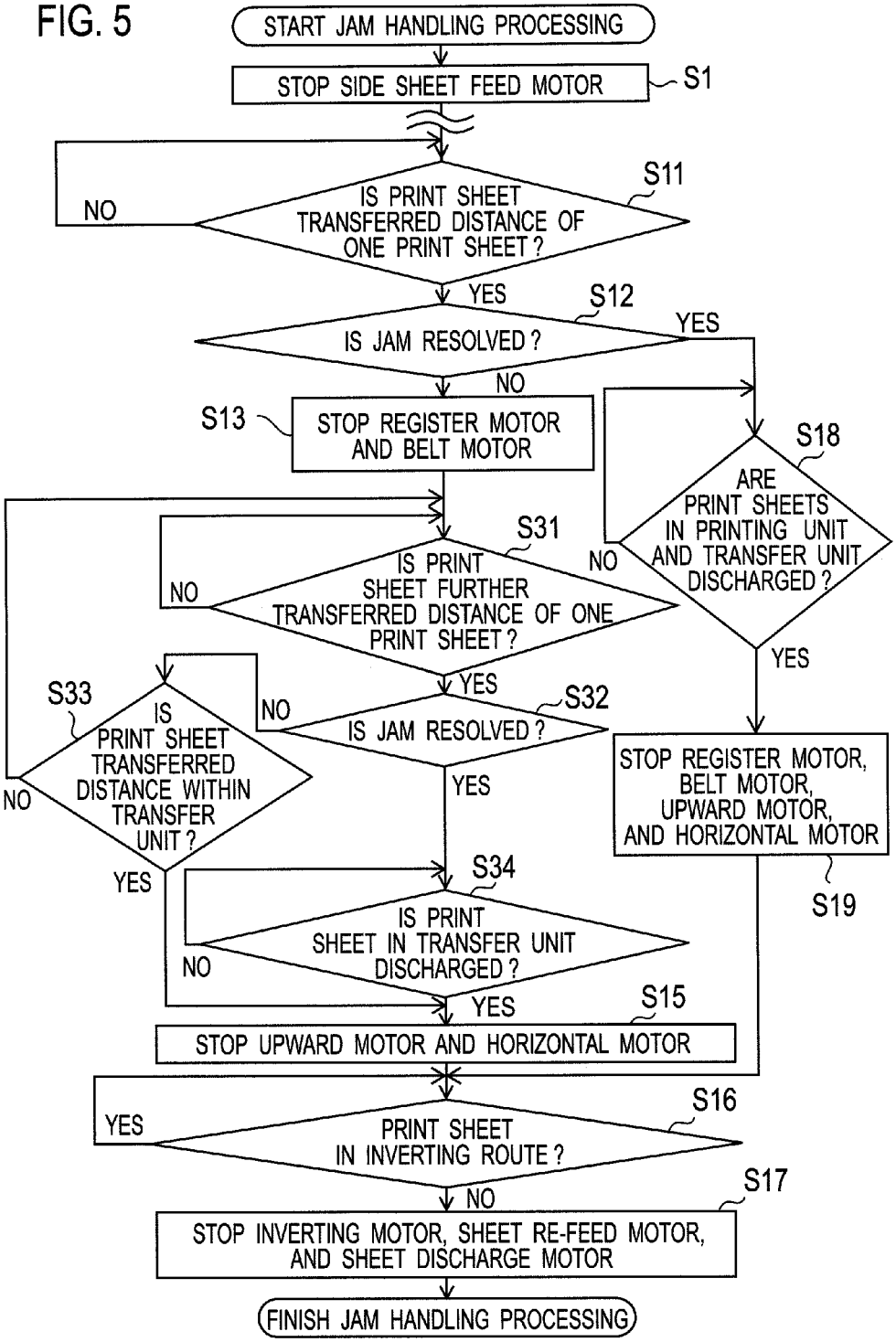
FIG. 5 is a part of a flow chart for explaining jam handling processing according to a third embodiment of the present invention.

The following are explanations of a third embodiment in which the jam handling processing of the above-described first embodiment is modified. FIG. 5 is a part of a flow chart for explaining jam handling processing according to the third embodiment. The same compositions as those in the first embodiment are indicated by the same reference numerals, and the explanations thereof are not repeated. In addition, the same processes as those in the first embodiment are indicated by the same step numbers, and the explanations thereof are not repeated.

First, in the jam handling processing according to the third embodiment, the step S1 to the step S13 are executed similarly to the first embodiment. Next, the controller 8 determines whether the print sheet PA is further transferred traveling the distance of just one print sheet (the transfer distance PL1) by the transfer unit 4 (S31). The controller 8 repeats the step S31 until the controller 8 determines that the print sheet PA is further transferred traveling the distance of one print sheet (the transfer distance PL1) by the transfer unit 4. When the controller 8 determines that the print sheet PA is further transferred traveling the transfer distance PL1 (S31: Yes), the controller 8 determines whether the jam is resolved or not (S32). When the controller 8 determines that the jam is not resolved (S32: No), the controller 8 determines whether the print sheet PA is transferred traveling the distance within the transfer unit (the sheet discharge distance PL2) (S33). Then, the controller 8 repeats the step S31 to the step S33 until the jam is resolved or the print sheet PA is transferred traveling the sheet discharge distance PL2. In other words, processing in the steps S31 to S 33 represents a condition that the controller 8 determines whether the jam is resolved for every transfer distance PL1 until the print sheet PA is transferred traveling the sheet discharge distance PL2.

Next, when the controller 8 determines that the jam is resolved (S32: Yes), the controller 8 determines whether the print sheets PA in the transfer unit 4 are discharged or not. The controller 8 repeats the step S34 until the print sheets PA in the transfer unit 4 are discharged. When the controller 8 determines that the print sheets PA in the transfer unit 4 are discharged (S34: Yes), the controller 8 executes processing of the steps from the step S15 similarly to the first embodiment so as to complete the jam handling processing.

Meanwhile, when the controller 8 determines that the jam is not resolved and the print sheet PA is transferred traveling the sheet discharge distance PL2 (S33: Yes), the controller 8 executes processing of the steps from the step S15 similarly to the first embodiment so as to complete the jam handling processing.

In addition, when the controller 8 determines that the jam is resolved in the step S12 (S12: Yes), the controller 8 executes processing of the step S18 and the step S19 and the step S16 and the step S17 similarly to the first embodiment so as to complete the jam handling processing.

In the third embodiment as described above, after stopping the motors 24 and 25 of the printing unit 3, the determination process of the jam resolution is repeated several times while the transfer of the print sheet by the transfer unit 4 is maintained. Therefore, it is possible to improve the probability of resolving the jam in the transfer unit 4 from which the print sheet PA is difficult to be removed.

The following are explanations of a modified embodiment in which some parts of the above embodiments are modified.

A configuration, location, value, material, and the like of each component composed of the above-described embodiments can be appropriately modified. In addition, the above-described embodiments may be combined.

In the above-described embodiments, the present invention is applied to the printer for both-side printing. Meanwhile, the present invention may be applied to other printers such as a printer for one-side printing.

In the above-described embodiments, the print sheets being transferred in the printing unit and the transfer unit are discharged to the sheet receiving tray after the jam is detected. Meanwhile, the print sheets of which print processing is completed may be discharged to the sheet receiving tray, and the print sheets in process of printing may be transferred to the switchback unit.

In addition, when the sheet feed route is long, the step S9 and the step S10 may be performed after the step S11 or the step S12. Moreover, when the sheet feed route is long and two print sheets are present in the sheet feed route, the sheet feed unit may be stopped after the two print sheets are nipped by the junction sheet feed rollers. Specifically, when the foregoing print sheet is nipped by the junction sheet feed rollers, the junction sheet feed rollers are stopped once. Then, when the second print sheet reaches a position in which the second print sheet can be nipped by the junction sheet feed rollers, the junction sheet feed rollers are rotated with a half turn or one turn so that the front edge of the second print sheet reaches downstream of the junction sheet feed rollers. The controller determines whether the second print sheet reaches the position in which the second print sheet can be nipped by the junction sheet feed rollers based on a sheet detection by the sheet sensors of the sheet feed unit, an interval after detection and a sheet feed rate. Furthermore, even when three or more print sheets are present in the sheet feed route, similar control processing may be repeated so that the front edge of the print sheet reaches adjacent to and downstream of the junction sheet feed rollers.

A printer according to the embodiments of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A printer comprising:

a printing unit configured to print on print media while transferring the print media in a transfer direction by a first transfer section;

a transfer unit located downstream the printing unit in a transfer route and configured to transfer the print media by a second transfer section; and a controller configured to receive a signal from a sheet detecting unit and provide a signal to the transfer unit thereby controlling the printing unit and the transfer unit and stopping the first transfer section prior to stopping the second transfer section upon detection of a jam of the print media by the sheet detecting unit, wherein the controller is further configured to, after detection of the jam by the sheet detecting unit, both maintain a transfer of the second print medium by the second transfer section and unconditionally stop the first transfer section, after unconditionally stopping the first transfer section, control the second transfer section to transfer the second print medium in the second transfer section a prescribed distance in the second transfer section and in the second transfer direction, after controlling the second transfer section to transfer the second print medium in the second transfer section the prescribed distance, determine whether the jam is resolved by the transfer of the second print medium the prescribed distance using signals received from the sheet detecting unit, upon determining that the jam is resolved by the transfer of the second print medium the prescribed distance, drive the first transfer section again to discharge a first print medium being stopped, and after controlling the first or second transfer sections to discharge the print medium being stopped in the first transfer section, stop the first transfer section and the second transfer section, wherein the prescribed distance is a distance of one printed sheet.

2. The printer according to claim 1, further comprising:

a print medium supply unit configured to supply and transfer the print medium to the printing unit, wherein the controller is configured to control the print medium supply unit and stop transfer by the print medium supply unit when determining that the print medium is present between the printing unit and the print medium supply unit after detection of the jam.

3. The printer according to claim 1, further comprising: an inverting unit configured to invert the print media by temporarily introducing the print media to a switchback unit having part exposed outward and re-feed the print media as inverted to the printing unit, wherein the controller is configured to control the inverting unit and, after detection of the jam, stop transfer by the inverting unit after the print media being transferred by the inverting unit is transferred to the switchback unit by the inverting unit after detection of the jam.

* * * * *